US009562373B1

(12) United States Patent
Young et al.

(10) Patent No.: US 9,562,373 B1
(45) Date of Patent: Feb. 7, 2017

(54) LOCK WITH INDEPENDENT REMOVABLE SHACKLES FOR INCREASED PORTABILITY

(71) Applicant: Allen C Young, Encinitas, CA (US)

(72) Inventors: Allen C Young, Encinitas, CA (US); Paige E Young, Encinitas, CA (US)

(73) Assignee: Allen C. Young, Encinitas, CA (US)

( * ) Notice: Subject to any disclaimer, the term of this patent is extended or adjusted under 35 U.S.C. 154(b) by 0 days.

(21) Appl. No.: 14/887,048

(22) Filed: Oct. 19, 2015

Related U.S. Application Data

(63) Continuation of application No. 14/193,124, filed on Feb. 28, 2014, now Pat. No. 9,163,431.

(60) Provisional application No. 61/956,429, filed on Jun. 10, 2013.

(51) Int. Cl.

| | |
|---|---|
| ***E05B 67/06*** | (2006.01) |
| ***E05B 73/00*** | (2006.01) |
| ***E05B 71/00*** | (2006.01) |
| ***E05B 67/36*** | (2006.01) |

(52) U.S. Cl.
CPC ..... *E05B 67/06* (2013.01); *E05B 67/36* (2013.01); *E05B 71/00* (2013.01); *E05B 73/00* (2013.01)

(58) Field of Classification Search
CPC ..... B62H 5/00; B62H 2005/008; E05B 73/00; E05B 71/00; E05B 67/06; E05B 67/10; E05B 67/36; E05B 67/063; E05B 67/22; E05B 67/02
USPC ..... 70/14, 18, 58, 20–22, 38 A, 53, 233
See application file for complete search history.

(56) References Cited

U.S. PATENT DOCUMENTS

| | | | | |
|---|---|---|---|---|
| 3,924,426 | A | 12/1975 | Zane et al. | |
| 4,426,861 | A * | 1/1984 | Chillis | B62L 3/06 70/203 |
| 4,918,951 | A | 4/1990 | Kavizky | |
| 5,119,651 | A | 6/1992 | Yang | |
| 5,226,341 | A * | 7/1993 | Shores | B62H 5/00 224/420 |
| 5,438,854 | A | 8/1995 | Seraj | |
| 5,440,904 | A | 8/1995 | Su | |
| 5,505,064 | A | 4/1996 | Wang | |
| 5,832,753 | A * | 11/1998 | Nielsen | B62H 5/00 224/425 |
| 5,901,588 | A | 5/1999 | Frost | |
| 5,921,116 | A | 7/1999 | Goldenberg | |
| 6,718,802 | B2 | 4/2004 | Vito | |
| 6,820,448 | B1 * | 11/2004 | Hsieh | E05B 67/003 70/18 |
| 8,127,577 | B2 | 3/2012 | Buhl et al. | |
| 8,640,507 | B1 * | 2/2014 | Derman | E05B 67/06 70/14 |
| 8,839,650 | B2 * | 9/2014 | Zuraski | B62H 5/003 70/21 |
| 9,163,431 | B2 * | 10/2015 | Young | E05B 67/063 |
| 2004/0045328 | A1 | 3/2004 | Vito | |

(Continued)

OTHER PUBLICATIONS

International Preliminary Report on Patentability for application PCT/US2014/041783, mailed Dec. 15, 2015.

(Continued)

*Primary Examiner* — Suzanne Barrett
(74) *Attorney, Agent, or Firm* — FSP LLC

(57) ABSTRACT

A lock includes a locking body, a non-locking body, and at least two shackles each independently removable from both the locking and non-locking body.

11 Claims, 11 Drawing Sheets

(56) References Cited

U.S. PATENT DOCUMENTS

| | | | | |
|---|---|---|---|---|
| 2006/0150691 | A1* | 7/2006 | Truss | B62H 5/00 70/39 |
| 2011/0219829 | A1* | 9/2011 | Trunek | B62H 5/003 70/58 |
| 2012/0318028 | A1* | 12/2012 | Hahn | E05B 67/063 70/41 |
| 2014/0076010 | A1 | 3/2014 | Gold | |

OTHER PUBLICATIONS

International Search Report for application PCT/US2014/041783, mailed Oct. 8, 2014.

* cited by examiner

LOCK WITH INDEPENDENT REMOVABLE SHACKLES FOR INCREASED PORTABILITY

CROSS REFERENCE TO RELATED APPLICATIONS

The present application claims priority under 35 U.S.C 119 to U.S. provisional application No. 61/956,429, filed on Jun. 10, 2013, which is incorporated herein by reference in its entirety.

BACKGROUND

Conventional "U" locks utilize a single locking body and a curved shackle, with at least one end detachable from a recess in the locking body. Such locks are utilized frequently to secure bicycles against theft, for instance. "U" locks are bulky and difficult to conveniently store without interfering with operation of a bicycle. The "U" part of the lock creates a large moment arm from its mount, which creates torques on the lock's frame mount. The term "D" lock is also used for this type of lock, because the shape of the shackle.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

Preliminaries

Figure 1:
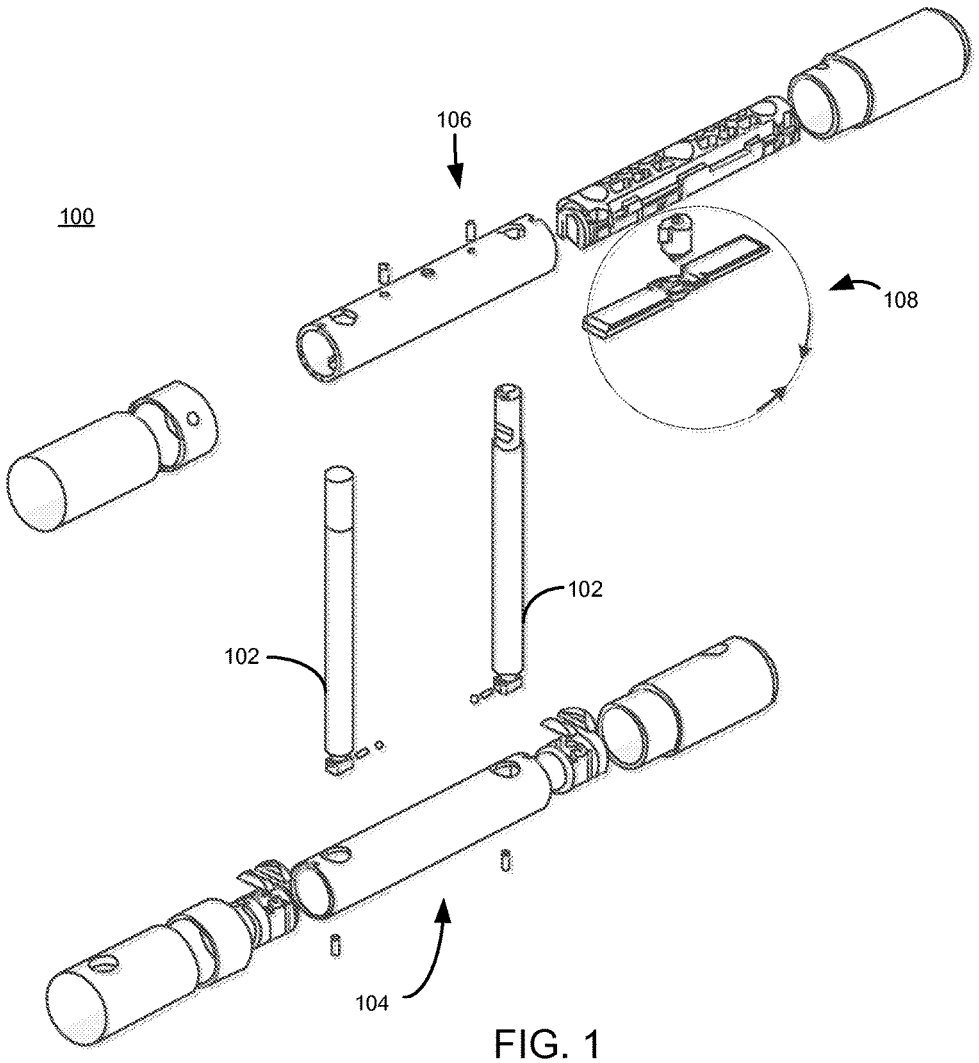
FIG. 1 illustrates an exploded view of an embodiment of a lock.

References to "one embodiment" or "an embodiment" do not necessarily refer to the same embodiment, although they may. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively, unless expressly limited to a single one or multiple ones. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list, unless expressly limited to one or the other.

The following terms are used herein:

"locking body" refers to a mechanical device that, once assembled, forms a single, individual component of a lock into which shackles may be secured in place with a locking mechanism.

"locking mechanism" refers to a mechanical device that requires some form of key to cause a change in its physical configuration. Examples are mechanical cylinder locks, and solenoid driven electrical bolts coupled to keypads or biometric readers. The "key" can be mechanical, or it could be a keypad sequence, or a biometric key, or a wireless proximity key, or other types of keys known in the art.

"non-locking body" refers to a mechanical device that, once assembled, forms a single, individual component of a lock into which shackles are inserted and retained, but with being secured in the non-locking body by a locking mechanism.

"shackle" refers to an individual mechanical component separable from both the locking body and non-locking body. A shackle may be constructed from rigid or flexible material.

"recess" refers to an indentation or hole in a structure.

"bolt" refers to a sturdy piece of material that resists forces to alter its configuration. A metal rod or shaft is an example of a bolt.

"keyway" refers to a port for inserting a mechanical key.

"linear" refers to a straight line. Those skilled in the mechanical arts will appreciate that no material is ever perfectly "straight", however each design and application has tolerances for what constitutes "straight" and "linear".

"mounting plate" refers to any mechanism for interfacing together the parts of independent devices that are removable from one another. Although illustrated herein as literally a "plate" of material, mounting plates need not be plates and many mounting plate designs are known or familiar to those skilled in the mechanical arts.

"post" refers to physical elements that protrude from a mounting plate. Exemplary posts are illustrated herein as being substantially linear and normal to the mounting plate, but this may vary according to the needs of the implementation.

"housing" refers to material formed to at least partially enclose components of a lock. The components are "housed" in the sense that they are situated within the material of the housing, although openings may be provided both for inserting the lock components, and for accepting elements such as keys and posts into or around the lock components.

Overview

Embodiments of a lock are described. The lock is unusual in that, when unlocked, it comes apart into at least four individual detached pieces. Although one skilled in the art may find it highly unusual to design a bicycle lock that comes apart of into so many individual pieces upon being unlocked, there are unexpected advantages to such a design.

Creative and synergistic selection of the dimensions of the lock components, along with complementary design of a storage facility, results in configurations in which the lock may be stored very efficiently on a bike frame. For example, a length of the shackles may be made similar to a length of the locking body and the non-locking body. During storage of the lock, all components may be arranged co-linear length wise for compact storage. Furthermore, diameters of the locking body and non-locking body may be made substantially larger than diameters of the shackles, so that the shackles fit within lateral cavities formed by stacking the non-locking body atop the locking body length wise, creating an efficient and tight storage bundle for the lock when it is not in a locked configuration.

DESCRIPTION

Figure 6:
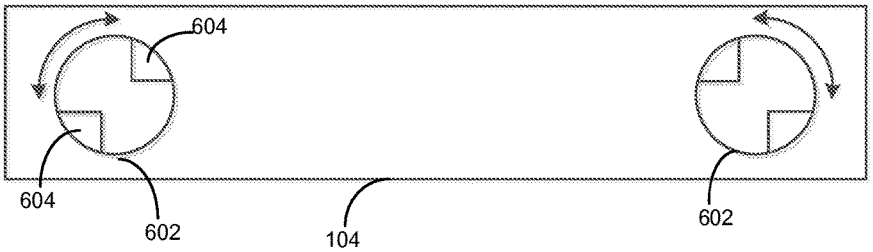
FIG. 6 illustrates a top view of an embodiment of the non-locking body.
Figure 7:
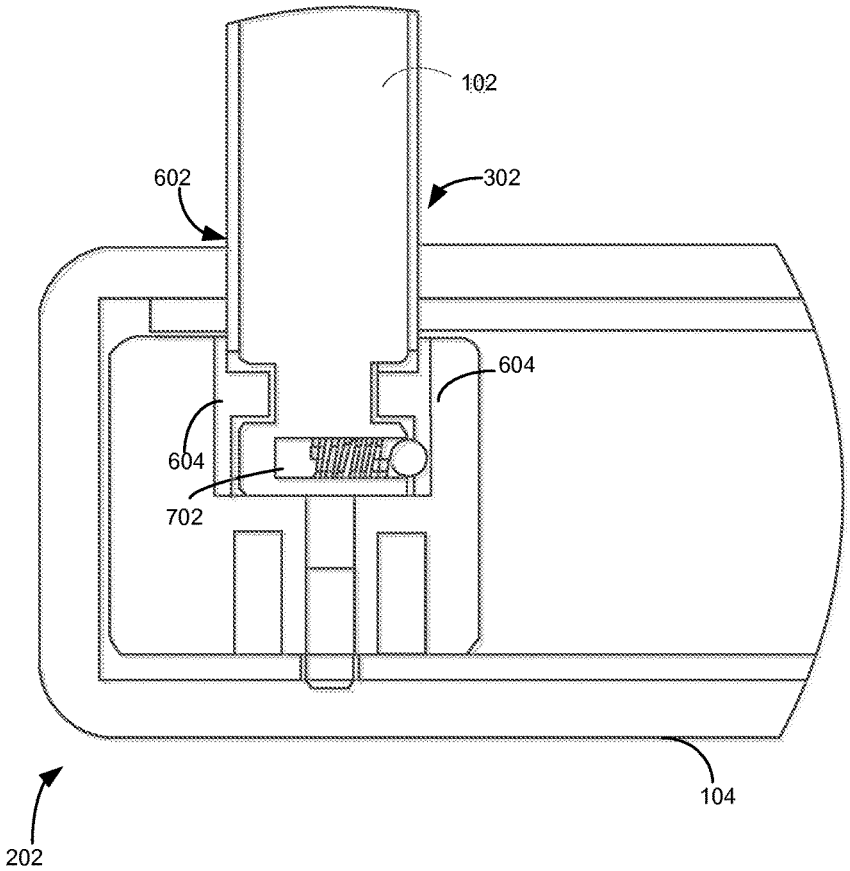
FIG. 7 illustrates a cutaway view on an embodiment of a secure engagement of the non-locking end of the shackle with the non-locking body.
Figure 8:
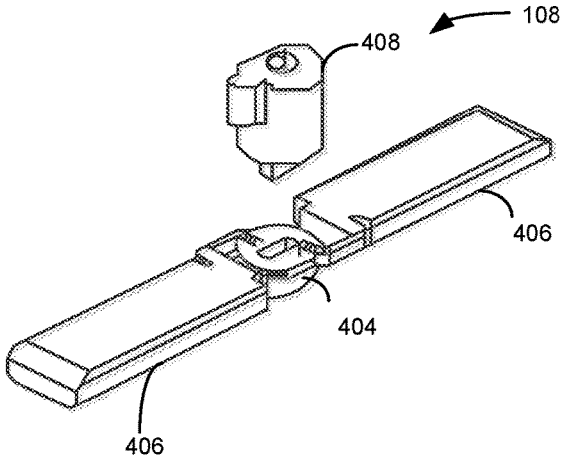
FIG. 8 illustrates a perspective view of an embodiment of a locking mechanism.

One embodiment of a lock 100 is illustrated in FIGS. 1-8. The lock includes shackles 102, non-locking body 104, and locking body 106. The lock 100 is configured such that the shackles 102 engage the non-locking body 104 on one end, and the locking body 106 on the other end, forming an enclosed area 206 there-between (e.g., a parallelogram). Other geometries of the formed lock 100 are also possible, including non-parallelograms formed from one or more nonlinear shackles. (FIG. 8)

A locking mechanism 108 is centrally located along the locking body 106. When engaged with a key in a keyway 402 to turn a cylinder 408, a bolt 406 is driven via a cam mechanism 404 into recesses in the ends 304 of the shackles 102, which are fitted into openings in the locking body 106 (see 204). In this manner the shackles 102 are secured into and together with the locking 106 body.

The opposite ends 302 of the shackles 102 maybe inserted in one orientation into holes 602 in the non-locking body 104 and then re-oriented (e.g., rotated) so that in the new orientation they may not be removed due to obstruction 604 within the non-locking body 104 (see 202). A spring loaded bearing 702 may help retain the end 302 of the shackle in the non-locking body 104. A typical manner of assembling the lock 100 is to first insert the shackles 102 into the non-locking body 104, rotate them into the orientation from which they cannot be removed, and then insert the other ends of the shackles 102 into the locking body 106 and engaging the locking mechanism 108 with a key. Note that the locking mechanism 108 on the locking body 106 does not have to be centrally located along the locking body's length, however, this would be the case in some embodiments.

Figure 10:
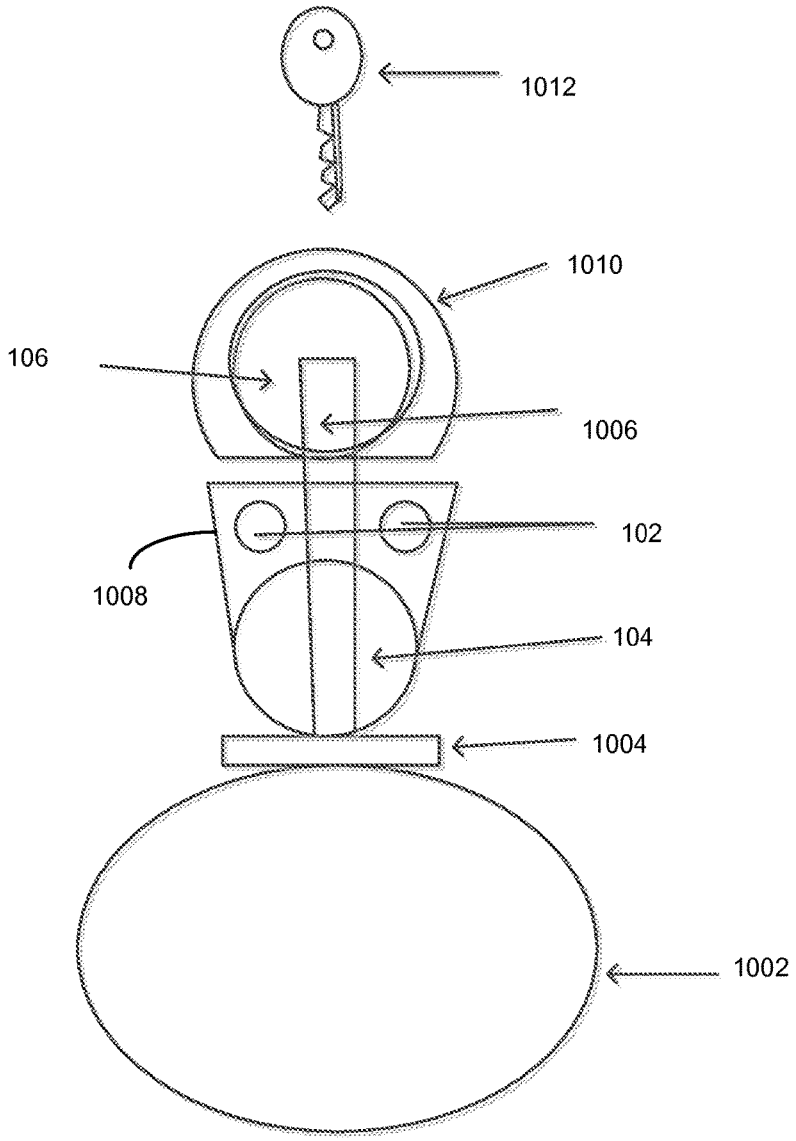
FIG. 10 and FIG. 11 illustrate a side view and exploded view of an embodiment of a lock storage facility.
Figure 11:
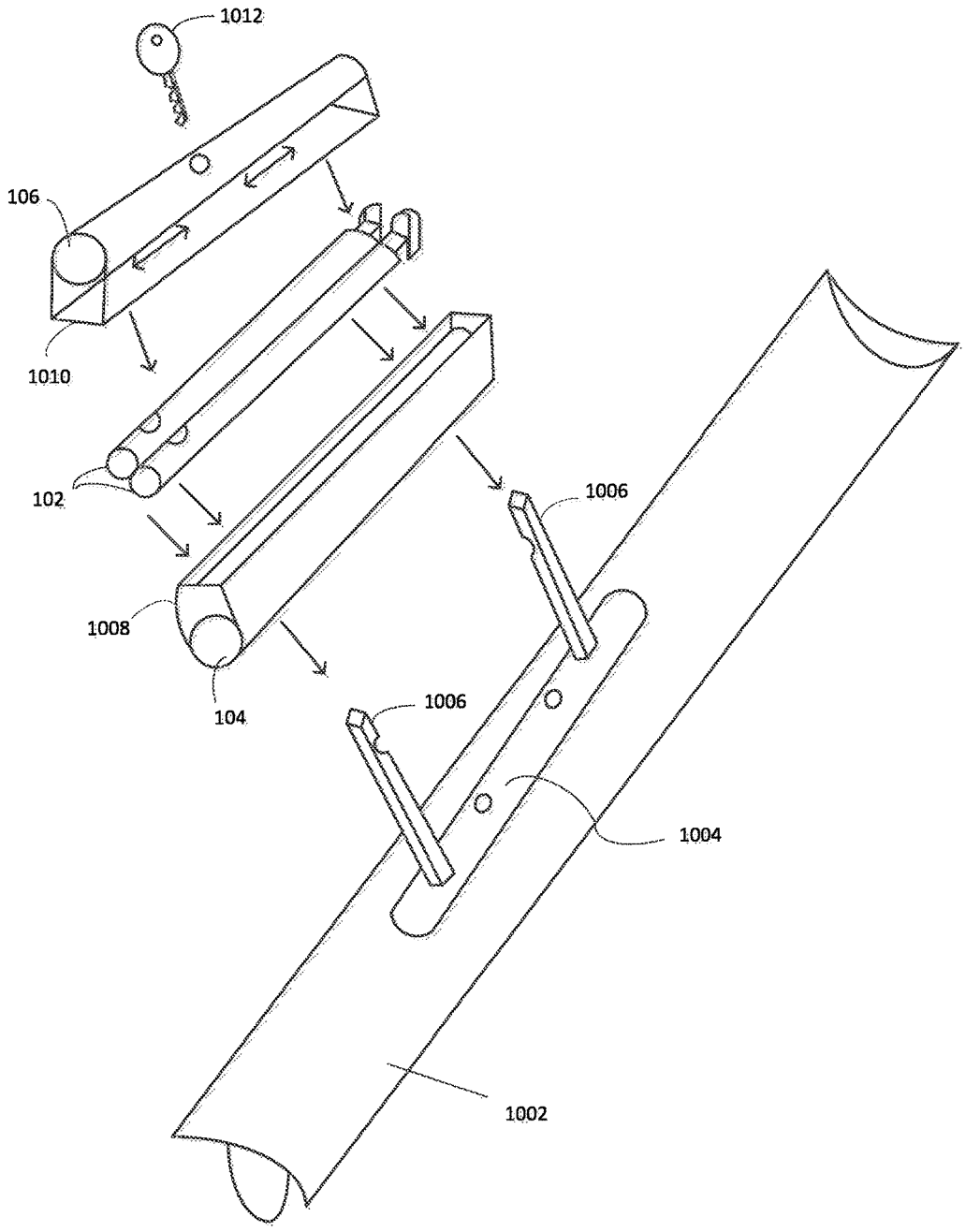

Referring to FIG. 10-11 an apparatus and mechanism for secure storage of a lock 100 in an unassembled configuration will now be described. A mounting assembly for the lock 100, for example, for mounting the lock 100 in a stored configuration on a bike 1002, frame includes a mounting plate 1004 which is securely bolted onto the frame 1002 of the bicycle, and posts 1006 which protrude outward normally from the mounting plate 1004 and which pass through the non-locking body. The outward ends of the posts 1006 are similar to the ends 304 of the shackles 102. A lower housing 1008 is positioned opening outward from the locking plate 1004 and the non-locking body 104 may be placed into the lower housing 1008 by sliding it over the post 1006.

The posts 1006 may be formed to pass through or around the non-locking body 104. As illustrated in FIG. 10-11, the posts pass through holes in the non-locking body 104 (holes not illustrated).

The shackles 102 may then be placed side by side within the lower housing 1008 on top of the non-locking body 104 and co-linear. The arrangement is such that the posts 1006 do not interfere with arranging of the shackles 102 against and alongside the non-locking body 104. Finally, the locking 106 body may be placed into an upper housing 1010 which exposes the key way 402 for the locking mechanism 108, and then the locking body 106 may be engaged with the ends of the posts 1006 in a manner similar to how the ends 304 of shackles 102 are engaged with the locking body 106 in the locked configuration. A key 1012 may be then inserted into the key way 402 and to lock turned the upper and lower housings 1008, 1010 together with the locking body 106 locked onto the posts 1006 and thus preventing removal of any of the other parts of the lock 100 from the bike frame.

The shackles need not to be formed into straight rods. In another embodiment (FIG. 9), one or both of the shackles are formed into a bent configuration 902 which flares outward into an angle or curve at a first point along the length of the shackle 902 and then turns inward and then upward again. Herein the term "upward" refers to a first direction, and "outward" and "inward" refer to directions non-linear with the upward direction. The angles or curves need not be right angles to the upward direction, although this will be the case in some embodiments. In general, the length of one or more of the shackles is extended using curves/bends to increase the locking area 206 formed between the non-locking body, the locking body, and the two shackles in the locked configuration.

The shackles 102 may, for example range from 8 mm up to 18 mm in diameter. In some embodiments the shackles 102, the non-locking body 104, and the locking body are the same diameter. In other embodiments, the shackles 102 have a substantially smaller (e.g., 50% to 75%) diameter than the locking body 104 and non-locking body 106 in order to facilitate more compact storage in the disassembled configuration. Example ratios of the diameters of the lock bodies and shackles 102 for such embodiments are between 1.25:1 and 1.5:1.

DRAWINGS

FIG. 1 illustrates an exploded view of an embodiment of a lock 100. The major components of the lock 100 are the locking body 106, the non-locking body 104, the locking mechanism 108, and the shackles 102.

Figure 2:
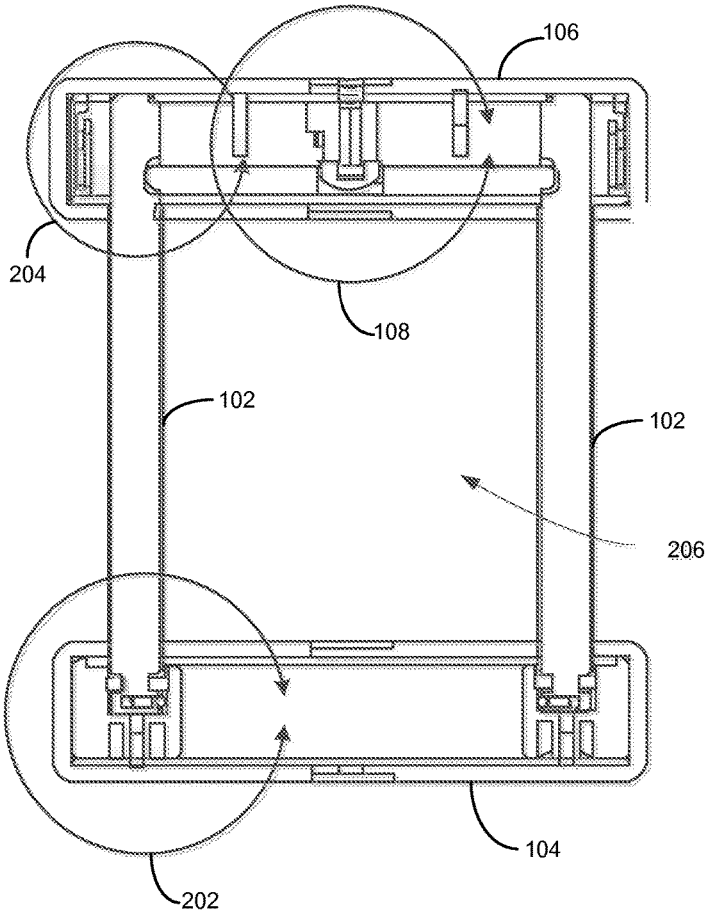
FIG. 2 illustrates a front cut-away view of an embodiment of a lock.

FIG. 2 illustrates a front cut-away view of an embodiment of a lock 100 in a locked configuration. Details are shown (204) of the locking mechanism 108 securing the shackles 102 to the locking body 106. Details (202) are also shown of engaging the shackles 102 with the non-locking body 104. A secure area 206 is formed between the shackles 102, the non-locking body 104, and the locking body 106.

Figure 3:
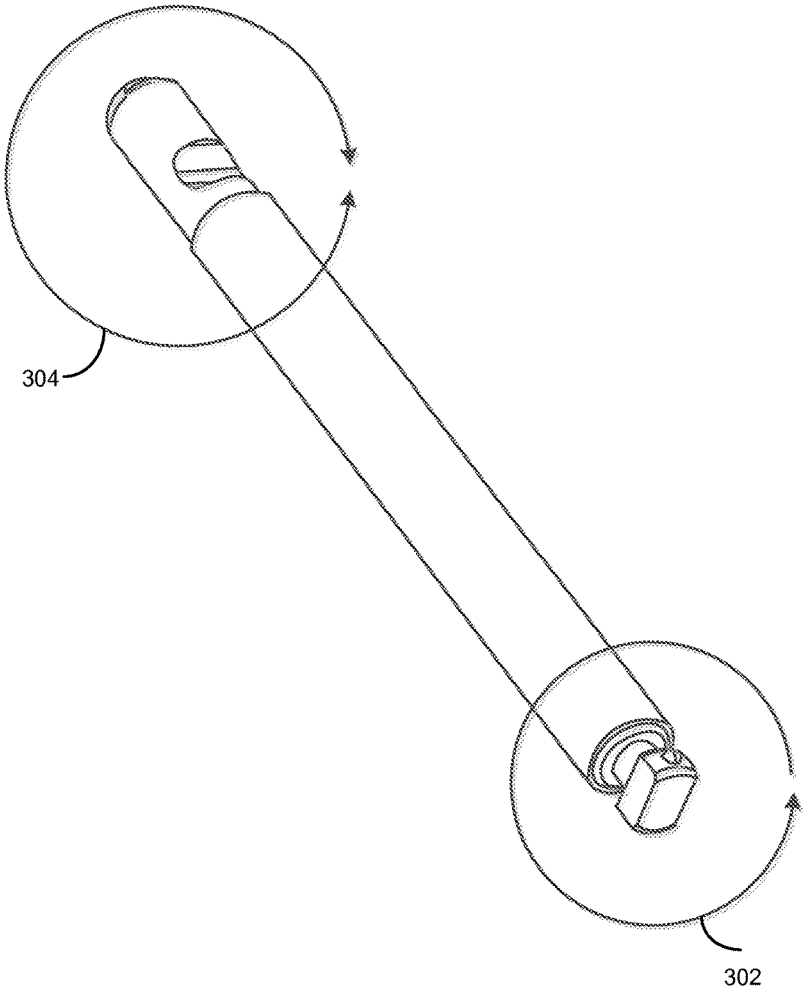
FIG. 3 illustrates a perspective view of an embodiment on a shackle, including details of a locking end and a non-locking end.

FIG. 3 illustrates a perspective view of an embodiment on a shackle, including details of a locking end (304) and a non-locking end (302).

Figure 4:
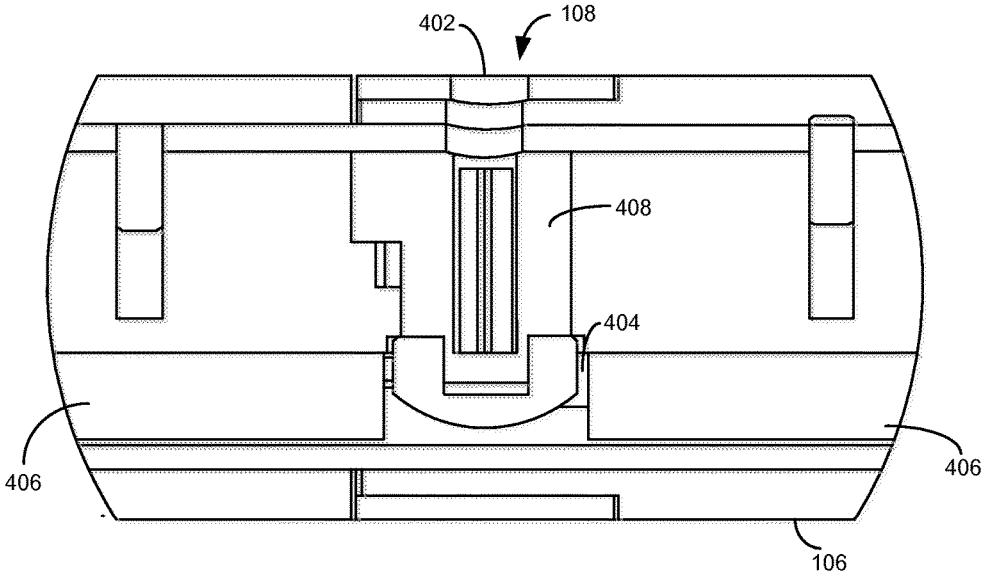
FIG. 4 illustrates a cut-away view of a locking mechanism.

FIG. 4 illustrates a cut-away view of a locking mechanism 108, including a keyway 402, lock cylinder 408, and cams 404 for driving a locking bolt 406.

Figure 5:
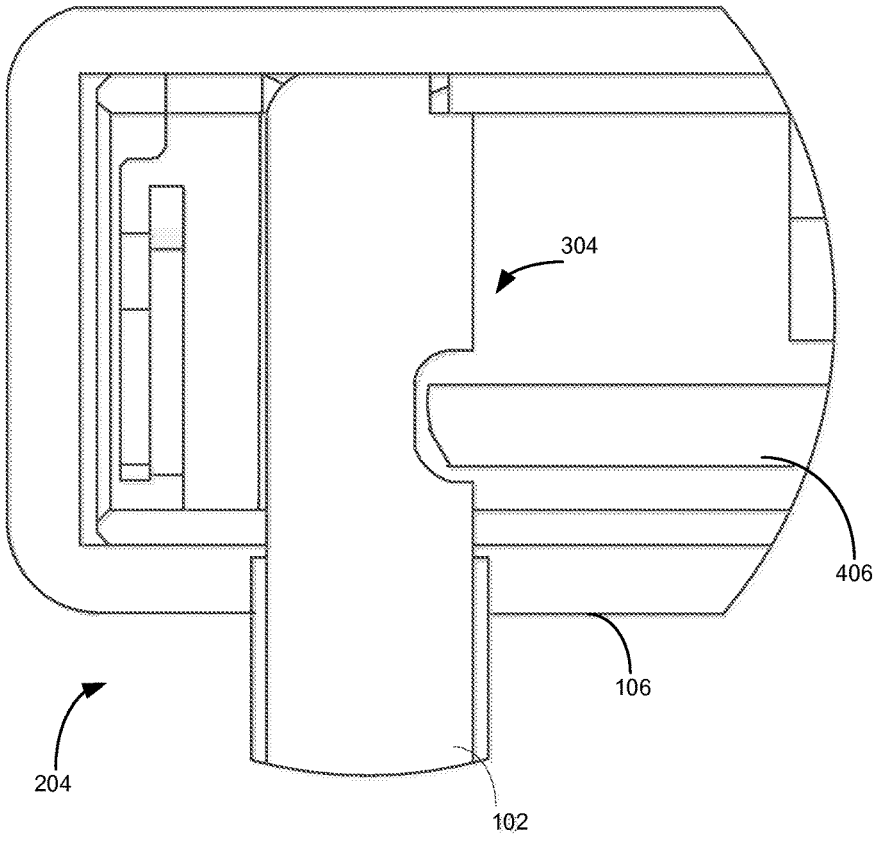
FIG. 5 illustrates a cutaway view of an embodiment of secure engagement of the locking end of the shackle with the locking body.

FIG. 5 illustrates a cutaway view of an embodiment of secure engagement of the locking end 304 of the shackle 102 with the locking body 106.

FIG. 6 illustrates a top view of an embodiment of the non-locking body 104, in which openings 602 to receive the non-locking ends 302 of the shackles 102 in a first orientation, and which include obstructions 604 to prevent removal of the shackles 102 in a second, secure orientation.

FIG. 7 illustrates a cutaway view on an embodiment of a secure engagement of the non-locking end 302 of the shackle 102 with the non-locking body 104. The non-locking end 302 of the shackle may include a spring-loaded bearing assembly 702 to facilitate assembling the lock into the locked configuration.

FIG. 8 illustrates a perspective view of an embodiment of a locking mechanism 108, including a lock cylinder 408, bolts 406, and cam(s) 404.

Figure 9:
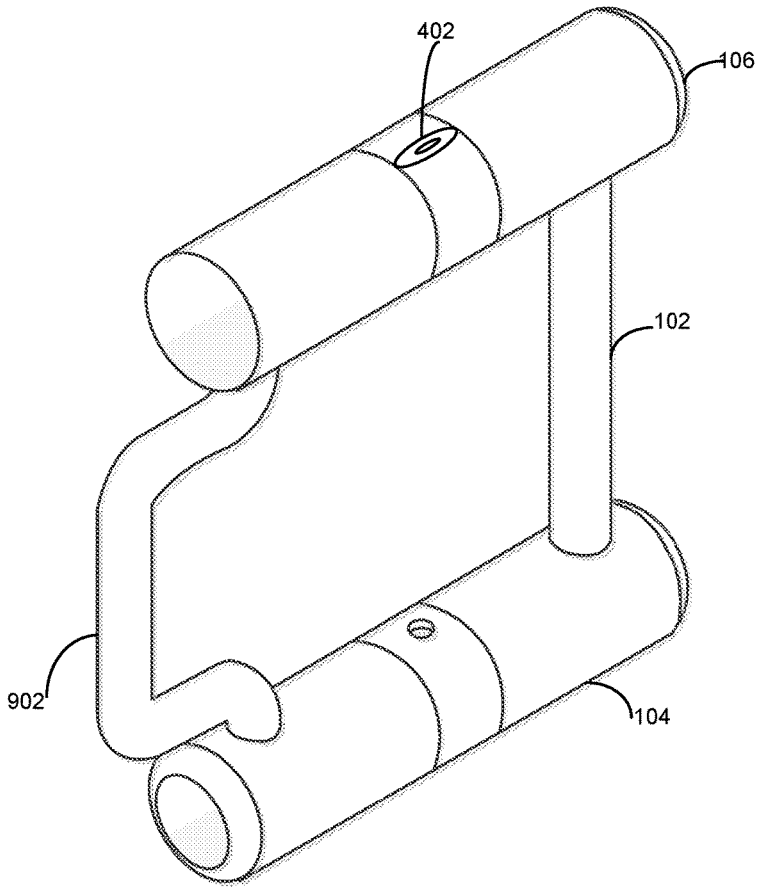
FIG. 9 illustrates a perspective view of an alternate embodiment of lock including at least one non-linear shackle.

FIG. 9 illustrates a perspective view of an alternate embodiment of lock including at least one non-linear shackle 902.

FIG. 10 and FIG. 11 illustrate a side view and exploded view of an embodiment of a lock storage facility. Components of a lock including a locking body 106, non-locking body 104, and shackles 102 are stored in compact form on a bike frame 1002 and secured with a key 1012. The storage facility utilizes a mounting plate 1004, posts 1006, an upper housing 1010, and a lower housing 1008 to securely store the individual components of the lock 100 in compact and secure fashion.

FIG. 12 illustrates an embodiment with two locking bodies 1202 and two shackles 1204. Note that the keyways are illustrated as being positioned at an end of the locking bodies, rather than centrally, but this positioning is not a requirement. Other geometries utilizing two locking bodied are also possible, including non-parallelograms formed from one or more nonlinear shackles. (FIG. 8 but with two locking bodies)

What is claimed is:

1. A lock, comprising:

a locking body;

a non-locking body physically independent from the locking body;

at least two shackles each independently removable from both the locking body and the non-locking body, the shackles comprising a first end of the shackles and a second end of the shackles opposite the first end of the shackles; and the lock formed so that in an unlocked position the shackles insert into the locking body and the non-locking body at the first end of the shackles and the second end of the shackles, respectively, and rotate within the locking body and the non-locking body from the unlocked position into a locking alignment position.

2. The lock of claim 1, further comprising:

the locking body comprising first recesses into which the first end of the shackles may be inserted;

the first recesses configured with a movable bolt coupled to a keyway; and the movable bolt configured to securely engage the first end of the shackles upon operation of the keyway.

3. The lock of claim 2, the first end of the shackles comprising notches less than a full circumference of the first end of the shackles.

4. The lock of claim 2, further comprising:

the non-locking body comprising second recesses into which the second end of the shackles may be inserted; and the second recesses configured with an angle constraint to constrain an angle at which the second end of the shackles are accepted into the second recesses, and to allow rotation of the shackles once inserted past the angle constraint of the second recesses.

5. The lock of claim 4, the second end of the shackles comprising knobs.

6. The lock of claim 5, the knobs comprise ball bearings to engage the non-locking body.

7. The lock of claim 6, each of the shackles is fully linear.

8. The lock of claim 1, further comprising:

each of the shackles is fully linear.

9. The lock of claim 1, further comprising:

a first shackle of the shackles is fully linear; and a second shackle of the shackles is at least partially non-linear.

10. The lock of claim 1, further comprising:

each shackle of the shackles is at least partially non-linear.

11. The lock of claim 1, further comprising: the locking body and the non-locking body having substantially identical dimensions.

* * * * *